US008293077B2

(12) United States Patent
Vacheron

(10) Patent No.: US 8,293,077 B2
(45) **Date of Patent: *Oct. 23, 2012**

(54) PROCESS FOR THE SURFACE TREATMENT OF HOLLOW PARTS, TANK FOR IMPLEMENTING SUCH A PROCESS, AND CONTINUOUS SURFACE TREATMENT PROCESS AND INSTALLATION USING SUCH A TANK

(75) Inventor: Frédéric Vacheron, Doussard (FR)

(73) Assignee: Tornos Management Holding SA, Moutier (CH)

( * ) Notice: Subject to any disclaimer, the term of this patent is extended or adjusted under 35 U.S.C. 154(b) by 1323 days.

This patent is subject to a terminal disclaimer.

(21) Appl. No.: 11/883,983

(22) PCT Filed: Jan. 26, 2006

(86) PCT No.: PCT/FR2006/000199

§ 371 (c)(1),
(2), (4) Date: Aug. 8, 2007

(87) PCT Pub. No.: WO2006/084973

PCT Pub. Date: Aug. 17, 2006

(65) Prior Publication Data

US 2008/0257717 A1 Oct. 23, 2008

(30) Foreign Application Priority Data

Feb. 9, 2005 (FR) ..... 05 01323

(51) Int. Cl.
*C25D 17/00* (2006.01)

(52) U.S. Cl. ..... 204/201; 204/227

(58) Field of Classification Search ..... 204/201, 204/227

See application file for complete search history.

(56) References Cited

U.S. PATENT DOCUMENTS

| | | | | |
|---|---|---|---|---|
| 1,442,514 | A | 1/1923 | Bell | |
| 1,997,013 | A | 4/1935 | Potthoff | |
| 2,316,972 | A | 4/1943 | Pond | |
| 2,935,989 | A * | 5/1960 | Arnold | 134/46 |
| 3,849,284 | A | 11/1974 | Kossmann | |
| 4,405,431 | A * | 9/1983 | Pfeifer et al. | 204/202 |
| 4,581,260 | A | 4/1986 | Mawla | |
| 4,659,445 | A * | 4/1987 | Bogdan et al. | 204/479 |
| 4,908,153 | A * | 3/1990 | Kossmann et al. | 204/625 |
| 7,026,015 | B2 | 4/2006 | Kreuzer | |
| 2009/0057138 | A1 * | 3/2009 | Vacheron | 204/242 |
| 2010/0024852 | A1 * | 2/2010 | Vacheron | 134/56 R |

FOREIGN PATENT DOCUMENTS

| | | |
|---|---|---|
| CH | 653374 | 12/1985 |
| DE | 2119401 | 11/1972 |
| DE | 29814487 U | 1/1999 |

(Continued)

*Primary Examiner* — Luan Van
(74) *Attorney, Agent, or Firm* — Frommer Lawrence & Haug LLP; Ronald R. Santucci

(57) ABSTRACT

The invention relates to a method for treating surfaces of hollow parts, this method being a conversion treatment such as an anodizing, and to a method according to which the hollow pieces are completely immersed inside at least one treatment tank containing a liquid, characterized in that each hollow piece is immersed while making it execute at least one rotational movement so that air bubbles likely to be created inside the tank are removed from the inner wall of the hollow part.

10 Claims, 5 Drawing Sheets

FOREIGN PATENT DOCUMENTS

| | | | |
|---|---|---|---|
| EP | 1 433 537 | A | 6/2004 |
| FR | 2900161 | A | 10/2007 |
| GB | 726180 | | 3/1955 |
| JP | 38-1712 | | 7/1935 |
| JP | 57-204091 | | 6/1956 |
| JP | 47-11706 | | 5/1972 |
| JP | 62-72175 | | 5/1987 |
| JP | 63-310998 | A | 12/1988 |
| JP | 1-78170 | U | 5/1989 |
| JP | 2-305999 | A | 12/1990 |
| JP | H05-195290 | | 8/1993 |
| JP | 2001-501532 | | 2/2001 |
| JP | 2001-198508 | A | 7/2001 |
| JP | 2001-199539 | | 7/2001 |
| JP | 2004-509745 | A | 4/2004 |
| JP | 2004-211116 | | 7/2004 |
| KR | 10-2000-61563 | | 10/2000 |
| RU | 1836499 | A | 8/1993 |
| SU | 761606 | | 9/1980 |
| SU | 1601209 | A | 10/1990 |

* cited by examiner

PROCESS FOR THE SURFACE TREATMENT OF HOLLOW PARTS, TANK FOR IMPLEMENTING SUCH A PROCESS, AND CONTINUOUS SURFACE TREATMENT PROCESS AND INSTALLATION USING SUCH A TANK

This application is a 371 of PCT/FR2006/000199 filed on Jan. 26, 2006, published on Aug. 17, 2006 under publication number WO 2006/084973 A1 which claims priority benefits from French Patent Application Number 0501323 filed Feb. 9, 2005, the disclosure of which is incorporated herein by reference.

BACKGROUND OF THE INVENTION

The present invention relates to a process and to a tank for the surface treatment of metal parts, and more particularly to a conversion treatment such as, for example, an anodization of an aluminum part. The invention also relates to a continuous surface treatment process and installation using such a tank.

DESCRIPTION OF THE PRIOR ART

Various processes for the surface treatment of parts, and more particularly metal parts such as aluminum parts, are already known. Mention may for example be made of the anodic treatment of aluminum and its alloys, barrier anodizing or anodic passivation, porous anodizing in acid medium or anodic dissolution or even electropolishing and hard or self-color anodizing. All these treatments require a prior step of preparing the parts.

In such preparation of the parts, the latter are for example degreased and rinsed by being dipped into various successive baths. For example, the parts are dipped into a degreasing bath then removed, so as thereafter to be dipped into a rinsing bath.

In these various existing processes, a predetermined number of parts is placed on suitable supports, such as for example those described in published patent application EP-A-1 433 537, which predetermined number of supports are themselves placed on what are called "charges". These charges are moved individually, from respective tank to respective tank, and immersed in each of said tanks through a succession of vertical lowering and raising movements by means of hoists.

There are numerous drawbacks with these existing processes.

Firstly, when the parts to be treated are hollow, it is found that air bubbles may appear on their inner walls while they are being lowered and/or raised from each of the tanks. These air bubbles may prove to be deleterious as they result in streaking of the active preparation and/or finishing solution on these walls, thereby impairing the homogeneity of deposition of active solution(s) and sometimes leading to certain parts thus treated being scrapped. Furthermore, it is necessary to construct often complex metal structures around the tanks so as to support the hoists themselves, which have to raise substantial charges. The many movements of the hoists and raised charges increase the risk of accidents. The charges are not necessarily constructed with perfect repeatability, thereby leading to differences in the range of treatment of the parts and therefore variations from one charge to another, which have to be regularly corrected. This correction essentially consists in adapting the treatment according to each charge. To maximize productivity, the charges are made with quite a large volume, thereby resulting in the tanks having to be of large dimensions and therefore resulting in the production of a large volume of polluting effluents. Finally, the use of hoists and the large dimensions of the installations for carrying out the process incurs maintenance costs that are likewise substantial.

The object of the invention is therefore to alleviate all or some of the drawbacks of the existing processes and installations employed, such as those mentioned above.

SUMMARY OF THE INVENTION

For this purpose, the present invention relates to a process for the surface treatment of hollow parts of the conversion treatment type, such as an anodizing treatment, in which process the hollow parts are completely immersed inside at least one treatment tank containing a solution, in which process each hollow part is immersed while making it undergo at least one rotational movement so that the air bubbles liable to be created inside the tank are expelled from the inner wall of said hollow part.

BRIEF DESCRIPTION OF THE DRAWINGS

Other features and advantages of the invention will become apparent from the description that follows, in conjunction with the appended drawings which are given merely by way of non-limiting example, namely.

DESCRIPTION OF THE PREFERRED EMBODIMENT

Figure 1A:
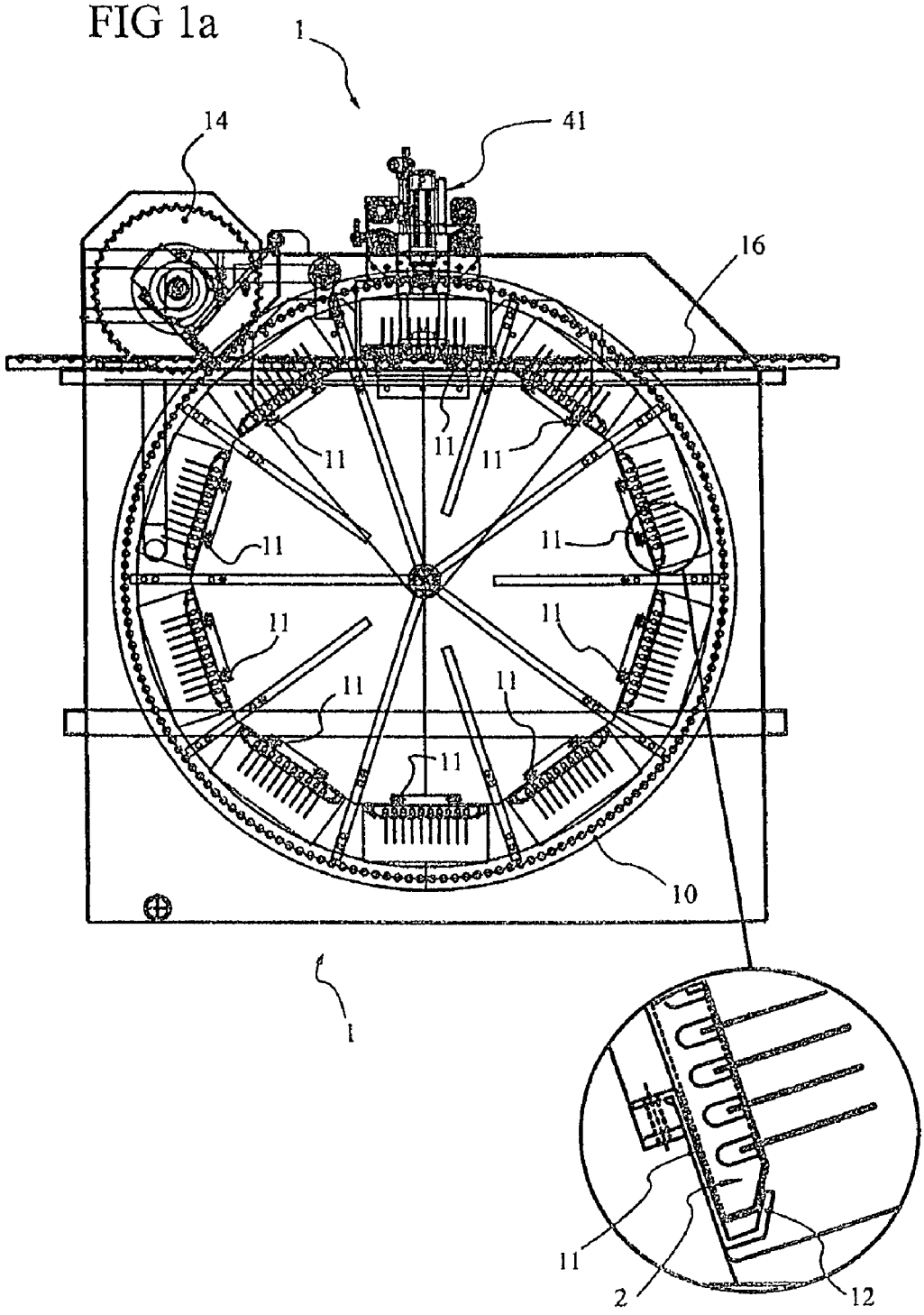
FIG. 1*a* is a front view illustrating a tank intended for implementing the surface treatment process of the invention.

According to an existing process for treating hollow parts intended to undergo a surface treatment of the conversion treatment type, such as for example an anodizing treatment, the hollow parts are completely immersed inside at least one treatment tank containing a solution. According to the process of the invention, each hollow part is immersed while making it undergo at least one rotational movement so that the air bubbles liable to be created inside the tank are expelled from the inner wall of said hollow part.

According to the embodiment illustrated, each hollow part is made to undergo a rotational movement of at least 90° and preferably 360°.

According to this illustrated embodiment, a predetermined number of said hollow parts are placed beforehand on a support which includes at least one retaining member capable of immobilizing each of them.

FIG. 1 illustrates a first embodiment given by way of example of a tank (1) intended for implementing the treatment process according to the invention.

According to this embodiment, the tank for treating the hollow parts, which bears the general reference (1), comprises, mounted so as to rotate inside the tank, a drum (10) to which each hollow part can be fastened. According to the embodiment illustrated, the drum (10) comprises, on its external periphery (100), at least one housing track (11) to which each hollow part can be fastened. More precisely, the drum (10) includes fastening means (12), integral with the housing track (11), which are capable of fastening each support (2) for the hollow parts by sliding, with interlocking, of the support (2) into the track (11). In the embodiment illustrated, the support (2) is as described in patent application EP-A-1 433 537.

Figure 1B:
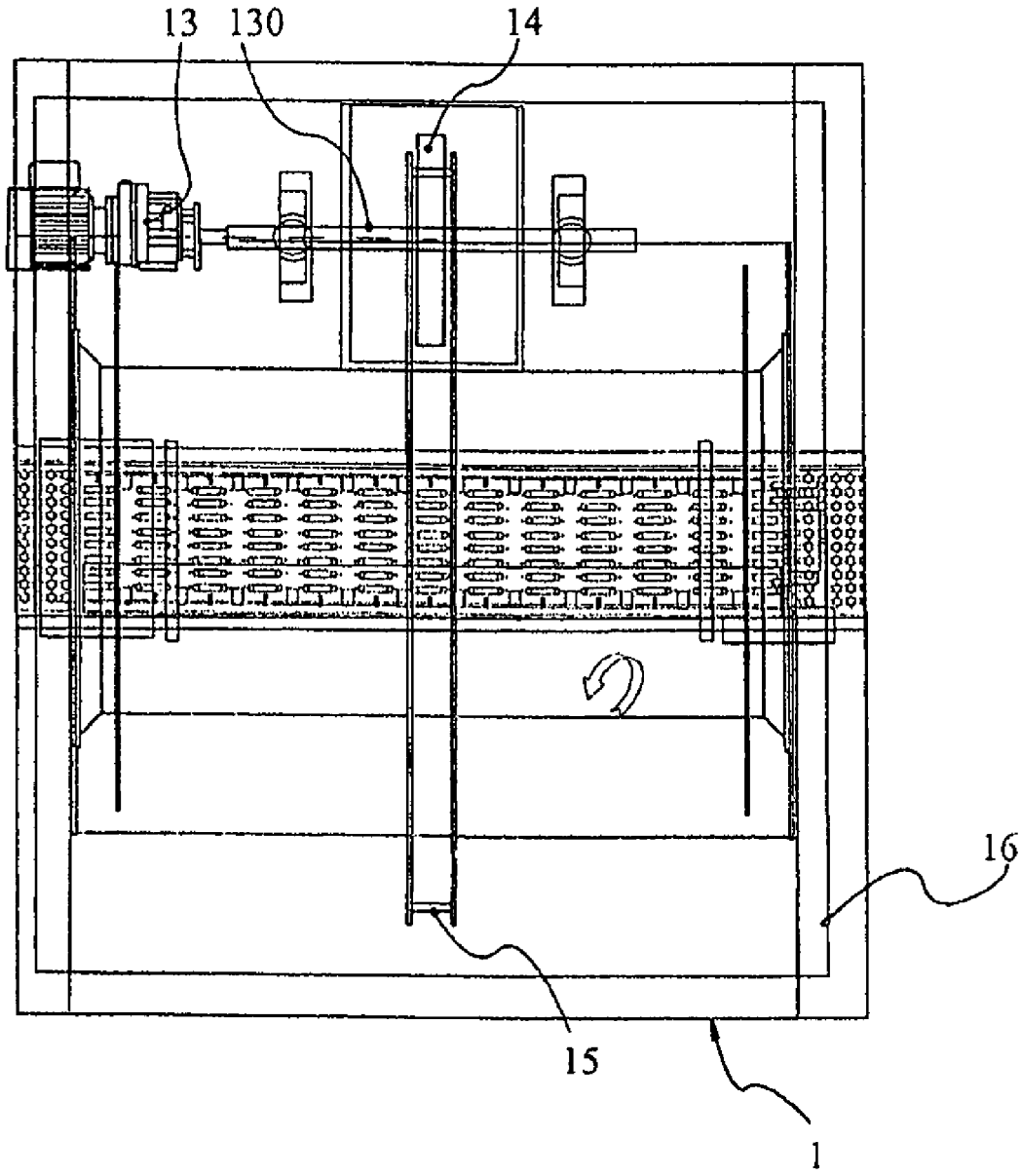
FIGS. 1*b* and 1*c* are top and side views, respectively, of the tank according to FIG. 1*a;*
Figure 1C:
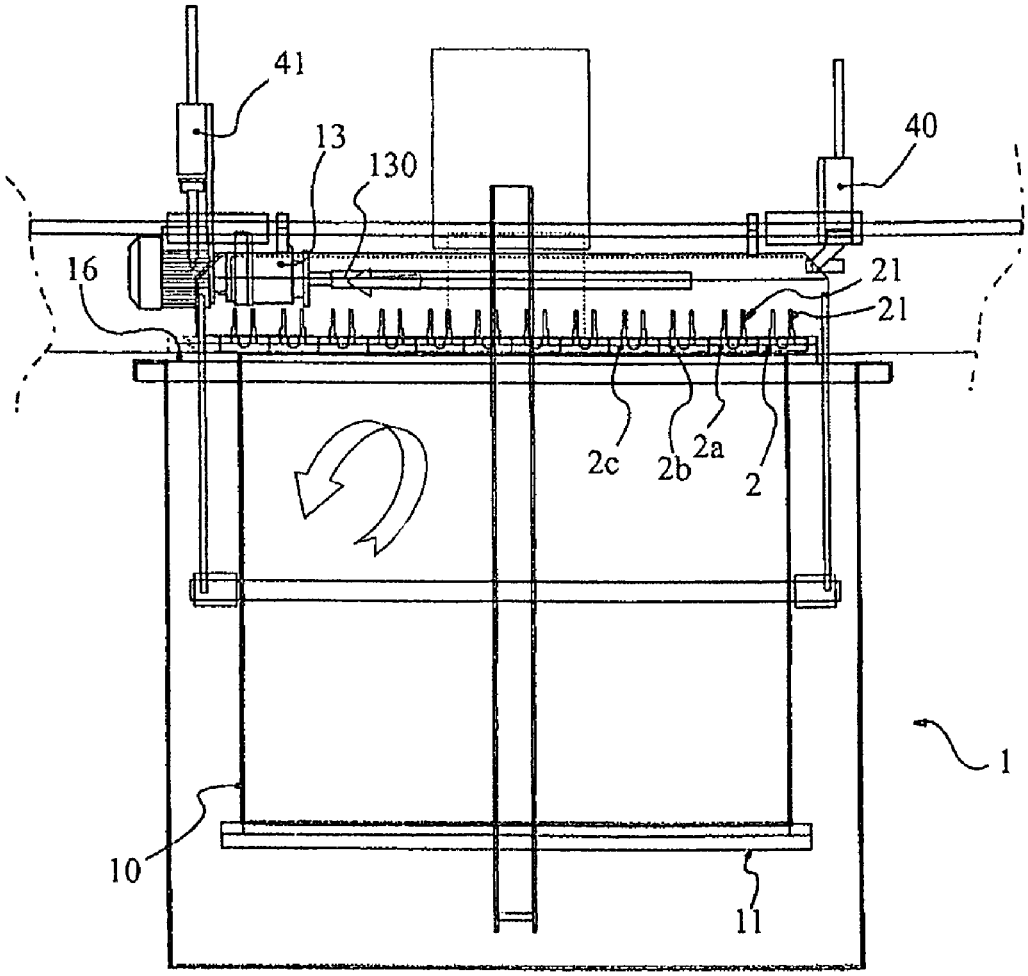
Figure 1D:
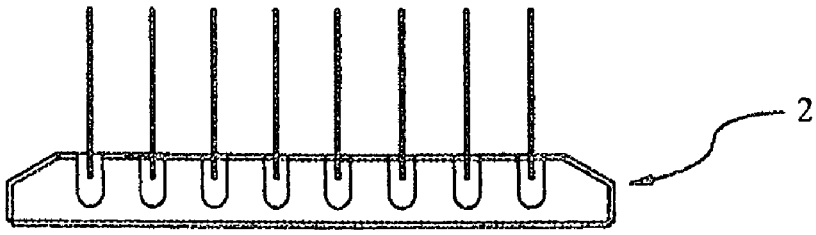
FIG. 1*d* is a side view of a preferred support (2) according to the invention, for supporting the parts.

For the sake of clarity, the hollow parts treated according to the invention have not been shown here, only their supports (2) being shown (see FIG. 1*d*). It goes without saying that all the movements undergone by each support are also undergone by the parts fastened to each support.

The tank (1) according to the invention includes its own motor means (13), here an electric drive motor, which rotates the drum (10). The tank (1) also includes, in the embodiment illustrated, its own transmission means (14, 15), which transmit the rotational movement of the motor (13) into a rotational movement of the drum (10). Here, in the illustrated embodiment of the invention, the drum (10) is cogged (15) and engages with a pinion (14) integral with the shaft (130) of the motor (13). The tank (1) includes thrust means (4, 40) for thrusting each support (2) from outside the tank into the immersion zone and extraction means (4, 41) for extracting each support (2) that has undergone a rotation from the exit zone to the outside, the thrust and extraction means being integral with the tank so as to constitute a stand-alone module.

Figure 2A:
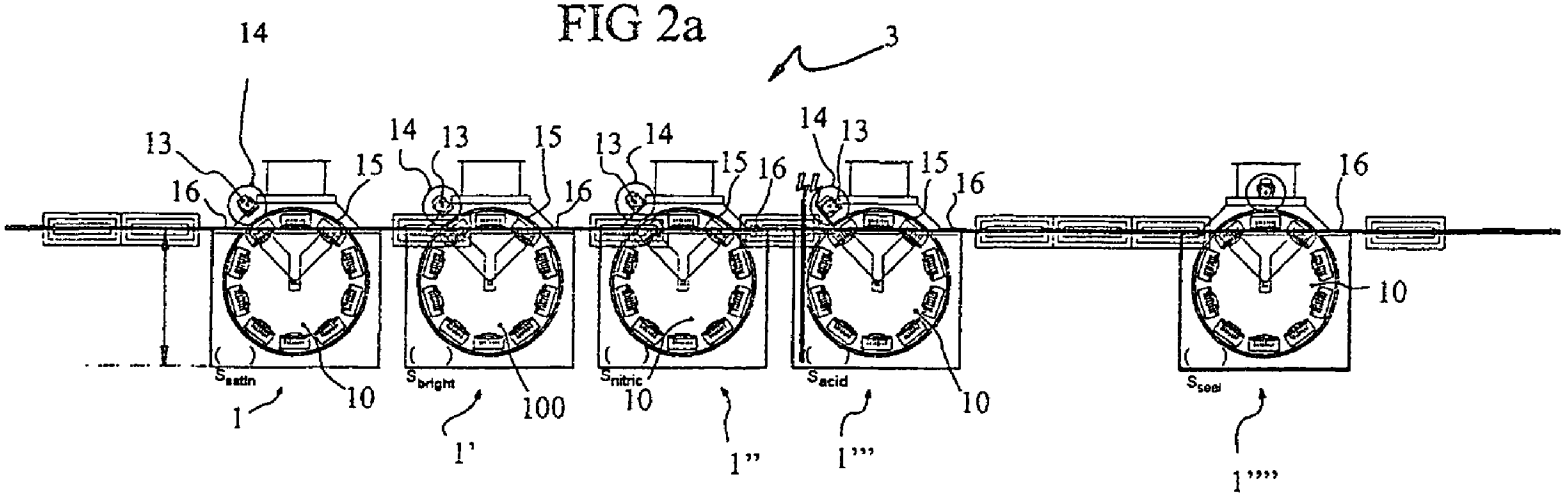
FIG. 2*a* is a front view illustrating a continuous installation intended for implementing the continuous surface treatment process of the invention and using a tank according to FIGS. 1*a* to 1*c*.
Figure 2B:
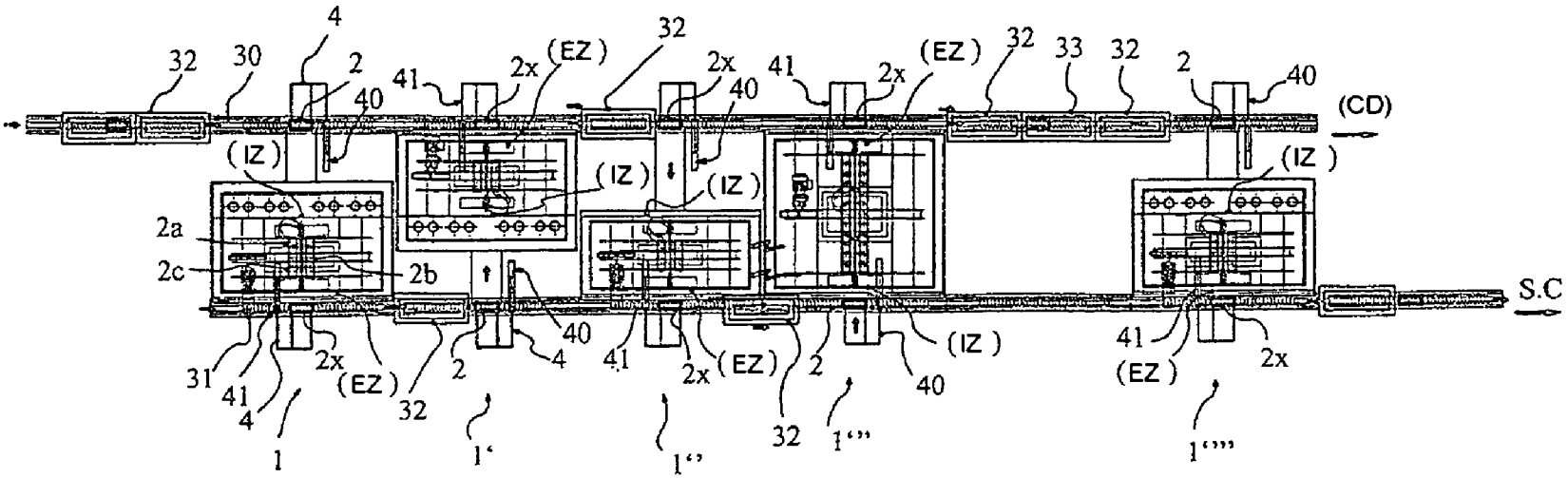
FIGS. 2*b* and 2*c* are top and side views, respectively, of the installation according to FIG. 2*a.*
Figure 2C:
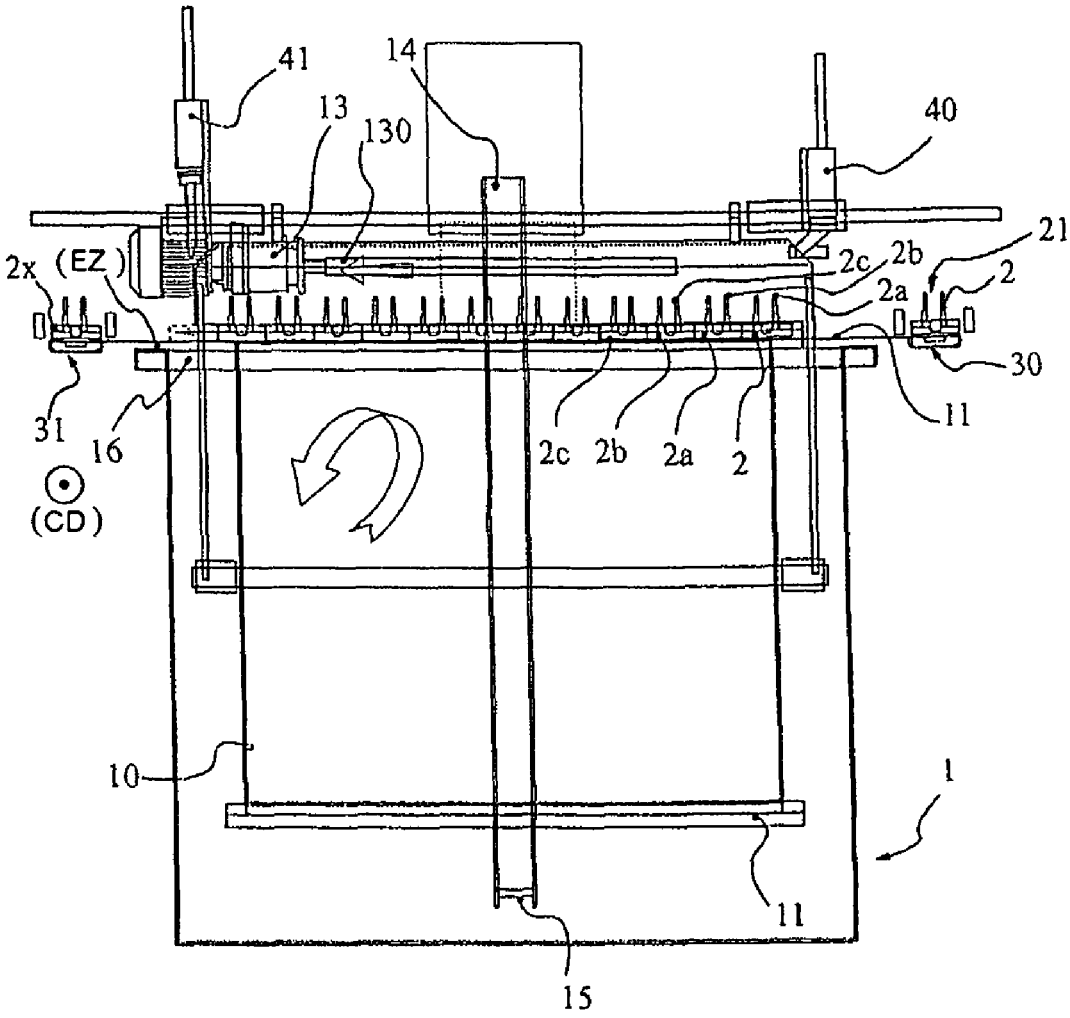

FIGS. 2*a* and 2*b* illustrate an embodiment of a continuous installation intended for implementing a continuous process for the surface treatment of hollow parts.

According to the continuous process of the invention for the surface treatment of hollow parts, at least one treatment tank (1) containing a solution, as described with reference to FIGS. 1*a* to 1*c*, is used and the following various steps are carried out:

- the supports (2) for the parts are positioned on a first conveyor chain (30) placed at the same height (H) as a zone of the tank (1) forming an immersion zone (IZ) and the supports (2) for the parts are delivered, by a horizontal thrust, from the first conveyor chain (30) into the immersion zone (IZ);
- the supports (2) for the parts are completely immersed in the solution contained in the tank (1); and
- the supports (2) for the treated parts are removed, by horizontal extraction from a zone of the tank (1) forming the exit zone (EZ) onto a second conveyor chain (31) placed at the same height as the exit zone (EZ).

According to the embodiment illustrated, each support (2) for the parts is immersed in the tank (1) while making it follow a helical path between the immersion zone (IZ) and the exit zone (EZ) of the tank (1).

Preferably, and according to the embodiment illustrated, a predetermined number of said hollow parts is placed beforehand on a support (2) which includes at least one retaining member (21), capable of immobilizing each of them, and said support (2) is introduced into the tank (1) so that it pushes at least one other support (2*a*) immersed beforehand in the tank (1), on which support another predetermined number of said hollow parts is placed and also including at least one retaining member (21*a*) capable of immobilizing each of the other predetermined number of parts, so as to discharge at least one other support (2, 2*a*, 2*b*, etc.) onto the second conveyor chain (31). Here, in the embodiment illustrated, all the supports (2, 2*a*, 2*b*, etc.) are identical and therefore each comprise the same number of retaining members (21, 21*a*, 21*b*, etc.). According to the process illustrated, the same number of hollow parts are therefore placed on a support (2) and the other support (2*a*, 2*b*, etc.). It goes without saying that the number of parts per support (2) may vary depending on the individual dimensions of the part(s) to be treated, only the dimensions of each support remaining invariant in the installation described.

According to the process illustrated, at least one rinsing step is carried out by spraying water onto at least one of the two conveyor chains (30, 31).

According to the process illustrated, at least one complementary successive tank (1', 1" etc.) containing a complementary treatment solution, also having an immersion zone (IZ) and at the same height as the second conveyor chain (31), is preferably used and each support (2) for the parts discharged from the tank is delivered by horizontal thrust from the second conveyor chain (31) into the immersion zone (IZ) of the complementary tank (1', 1", etc.).

According to the process illustrated, each support (2) for the parts treated in the complementary tank (1', 1", etc.) is preferably discharged by horizontal extraction from an exit zone (EZ) of the complementary tank (1', 1", etc.) onto the first conveyor chain (30) conveying in the same direction (CD) as in the case of the delivery of each support (2) for the parts into the preceding tank (1).

According to the embodiment illustrated, the continuous surface treatment process of the invention comprises the immersion of the hollow parts in five different active solutions ($S_{satin}$ or satinizing solution, $S_{bright}$ or brightening solution, $S_{nitric}$ or nitric solution, $S_{oxid}$ or oxidation solution and $S_{seal}$ or sealing solution) in successive steps so as to anodize said hollow parts.

The installation (3) according to the invention, intended for implementing the surface treatment process illustrated, comprises at least one treatment tank (1, 1', 1'" etc.) capable of containing a treatment solution ($S_{satin}$, $S_{bright}$, $S_{nitric}$, $S_{oxide}$, $S_{seal}$), a first conveyor chain (30), placed at the same height as an immersion zone (IZ) of the tank (1, 1', 1", etc.) and capable of delivering each support (2) for the hollow parts into said immersion zone, thrust means (4, 40) for horizontally thrusting each support (2) for the hollow parts from the first conveyor chain (30) into the immersion zone (IZ) of the tank, extraction means (4, 41) for horizontally extracting each support (2) for the treated parts from an exit zone (EZ) of the tank and delivering it to a second chain (31), placed at the same height as the exit zone (EZ) of the tank (1, 1', 1'" etc.) and capable of moving each support (2) for the treated parts away from the tank (1, 1', 1'" etc.).

According to the embodiment illustrated, the thrust means (4, 40) preferably comprises at least one hydraulic cylinder (40). Likewise, the extraction means (4, 41) preferably comprises at least one hydraulic cylinder (41). Here, in the embodiment illustrated, the hydraulic thrust cylinders (40) and hydraulic extraction cylinders (41) are identical and just one thrust cylinder (40) and one extraction cylinder (41) are placed facing each other, on either side of the tank (1). In the preferred embodiment, these thrust (40) and extraction (41) cylinders are mounted directly on each tank (1, 1', 1", 1'", 1"" etc.) so as to constitute a stand-alone module, which can be easily interchanged since it can be individually removed from the installation, for example in the event of a momentary failure or a change of treatment type.

Again, according to the embodiment illustrated, the two conveyor chains (30, 31) are capable of conveying a plurality of supports (2, 2*a*, 2*b*, etc.), a predetermined number of said hollow parts being placed on each of them and each comprising at least one retaining member (21, 21*a*, 21*b*, etc.) for immobilizing each of them.

According to the embodiment illustrated, the installation (3) includes at least one rinsing cell (32), for spraying water, placed around at least one of the two conveyor chains (30, 31).

It should be added that, in the embodiment illustrated, the tank (1) has, in its upper part, an opening (16) at the edge of which the immersion zone (IZ) and the exit zone (EZ) are respectively located.

Preferably, and according to the embodiment illustrated, the installation (3) includes at least two successive complementary treatment tanks (1, 1', 1", 1"" etc.) and the first (30) and second (31) conveyor chains are continuous and placed parallel to each other in such a way that the first chain (30) extends along the immersion zone (IZ) of the upstream tank (1) and along the exit zone (EZ) of the downstream tank (1', 1", 1"" etc.) and the second chain (31) extends along the exit zone (EZ) of the upstream tank (1) and along the immersion zone (IZ) of the downstream tank (1', 1", 1""etc.).

Preferably, and according to the embodiment illustrated, each first (30) and second (31) conveyor chain is continuous and straight.

Here, according to the preferred embodiment, the installation comprises five successive tanks (1, 1', 1", 1''', 1""), a downstream one (1''') of which is a tank for finishing the parts and the four other upstream tanks (1, 1', 1", 1''') are tanks for preparing and treating the parts. In the embodiment illustrated, the tanks (1, 1', 1", 1''', 1"") all have different dimensions so as to have the immersion time needed for treating the hollow parts in each active solution used as treatment solution ($S_{satin}$, $S_{bright}$, $S_{nitric}$, $S_{oxid}$, $S_{seal}$). In the exemplary embodiment illustrated, in which the treatment undergone is an anodizing treatment, the tank (1''') is an oxidation tank. It essentially differs from the other tanks (1, 1', 1", 1"") by the fact that a suitable current is made to flow therein, between the electrodes and the hollow parts to be treated, in order to produce an alumina layer of the desired thickness and quality. It goes without saying that the tanks (1, 1', 1", 1''', 1"") may all have the same dimensions and, where appropriate, be identical.

The operation of the continuous installation (3) according to the invention, as illustrated, is already apparent from the foregoing text, namely:

- the first conveyor chain (30) continuously delivers the supports (2, 2*a*, 2*b*' etc.) into the immersion zone (IZ) of the tank (1) furthest upstream, and then each support (2, 2*a*, 2*b*, etc.) is thrust horizontally above the opening (16) and individually by the thrust cylinder (40) along one of the housing tracks (11) of the barrel-forming drum (10);
- simultaneously, the support (2*x*) placed on the same housing track (11) is thrust by the support (2) delivered to the opposite end of said track (11) and then extracted by the extraction cylinder (41) facing the thrust cylinder (40) onto the second conveyor chain (31); and
- delivery of the support (2*x*) into the immersion zone (IZ) of the tank (1') immediately following the preceding tank (1) and located at the same edge as the exit zone (EZ) of the preceding tank.

The same support (2, 2*a*, 2*b*, etc., 2*x*) therefore follows the same conveying direction (CD) for each chain (30, 31) and therefore passes alternately from one chain (30) to the other (31) after immersion in one of the tanks (1, 1', 1", 1''', 1"").

The continuous process according to the invention advantageously makes it possible to eliminate all the existing hoists in the existing processes and consequently all the drawbacks (need to provide complex hoist support structures, reduction in maintenance operations, etc.) and the associated risks (numerous displacements, and therefore risk of accidents).

The continuous process according to the invention makes it possible to reduce the number of tanks needed and thus reduce the overall size of the treatment line. It also allows the consumption of water and the solutions, and also the resulting effluents of the treatment, to be better controlled, thereby improving the pollution control conditions.

Moreover, thanks to the process of the invention, the volume of solutions needed is reduced, thereby resulting in an appreciable saving, especially in active products.

It should also be noted that the spraying treatments are more reliable, since the spray time for each treatment solution may be perfectly controlled and reproduced, thanks to controlled solenoid valves.

It will be appreciated that rotational immersion of the hollow parts in the active solution of the tank ensures deposition homogeneity and elimination of internal bubbling, and therefore the solution acts perfectly on the hollow parts to be treated, whatever their shapes.

Furthermore, the treated hollow parts, which are moved in predetermined and limited numbers on a suitable support, may be better drained.

Of course, the invention is not limited to the embodiments described and shown by way of examples, rather it includes all technical equivalents and combinations thereof.

For example, means other than a drum may be provided for rotating the hollow parts in the tank as claimed.

Likewise, immediately after the oxidation tank (1'''), it is possible to install a coloring cell (33), intended to give a colored appearance to the hollow parts treated beforehand, directly between two rinsing zones (32) as illustrated in FIG. 2*b*.

The invention claimed is:

1. A treatment tank for implementing a surface treatment process of parts, in which the parts are immersed in at least one treatment liquid contained in a treatment tank, wherein said parts are fixed on a rotating structure, comprising:

the rotating structure being rotatably mounted inside said treatment tank and configured such that said parts are completely immersed in said treatment liquid by means of a rotational movement of said rotating structure, said rotational movement being chosen so that air bubbles liable to be created by the immersion of said parts are expelled from the surfaces of said parts, wherein said treatment tank includes a drum, mounted so as to rotate inside said treatment tank, said drum comprising, on its external periphery, at least one housing track configured to house and fasten a support for one or more parts, wherein the support is fastened by fastening means, wherein said fastening means are integral with said housing track, and are configured to fasten each support for the hollow parts by sliding, with interlocking of the support into the track, said housing track being parallel to the axis of said drum, and wherein said treatment tank comprises at the treatment tank's uppermost portion an opening, defining an immersion zone and an exit zone.

2. The treatment tank as claimed in claim 1, wherein said drum houses on its external periphery a plurality of equidistant housing tracks.

3. The treatment tank as claimed in claim 1, the tank including a motor means and its own transmission means operable to the drum.

4. The treatment tank as claimed in claim 3, wherein the drum is configured to engage with a pinion integral with the motor shaft.

5. The treatment tank as claimed in claim 1, which includes thrust means for thrusting each support from outside the tank into the immersion zone and extraction means for extracting each support, that has undergone a rotation, from the exit zone to the outside, the thrust and extraction means being integral with the tank so as to constitute a stand-alone module.

6. The treatment tank as claimed in claim 5, wherein the thrust means comprises at least one hydraulic cylinder, and wherein the extraction means comprises at least one hydraulic cylinder.

7. An installation intended for implementing a surface treatment process of parts, in which the parts are immersed in at least one treatment liquid contained in a treatment tank, wherein said parts are fixed on a rotating structure, the rotating structure being rotatably mounted inside said treatment tank and configured such that said parts are completely immersed in said treatment liquid by means of a rotational movement of said rotating structure, said rotational movement being chosen so that air bubbles liable to be created by the immersion of said parts are expelled from the surfaces of said parts, wherein said installation comprises at least one treatment tank, a first conveyor chain, placed at the same height as an immersion zone of said treatment tank and configured to deliver supports for the parts in front of said immersion zone, thrust means for horizontally thrusting each support for the parts from the first conveyor chain into the immersion zone of said treatment tank, extraction means for horizontally extracting each support for the treated parts from an exit zone of said treatment tank and delivering it to a second chain, placed at the same height as said exit zone of the said treatment tank and configured to move each support for the treated parts away from the treatment tank, and wherein said installation comprises at least two successive complementary treatment tanks, wherein the first and second conveyor chains are continuous and placed parallel to each other in such a way that the first chain extends along the immersion zone of the upstream tank and along the exit zone of the downstream tank and the second chain extends alone the exit zone of the upstream tank and along the immersion zone of the downstream tank.

8. The installation as claimed in claim 7, wherein each first and second conveyor chain is continuous and straight, wherein the axis of the drums of the successive treatment tanks are parallel one to the other, and wherein the conveyor paths are perpendicular to the said axis.

9. The installation as claimed in claim 7, which includes at least one rinsing cell, for spraying water, placed around at least one of the two conveyor chains.

10. The installation as claimed in claim 7, comprising five successive tanks, a downstream one of which is a tank for finishing the parts and the four other upstream tanks are tanks for preparing and treating the parts.

* * * * *